US007138594B2

(12) United States Patent
Hu et al.

(10) Patent No.: US 7,138,594 B2
(45) Date of Patent: Nov. 21, 2006

(54) PUSH SWITCH

(75) Inventors: Yong-Hui Hu, ShenZhen (CN); Yusho Nakase, Fu Jin (JP)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/102,029

(22) Filed: Apr. 7, 2005

(65) Prior Publication Data

US 2005/0287856 A1 Dec. 29, 2005

(30) Foreign Application Priority Data

Jun. 28, 2004 (TW) ..... 93118705 A

(51) Int. Cl.
*H01H 13/14* (2006.01)

(52) U.S. Cl. ..... 200/520; 200/5 A

(58) Field of Classification Search ..... 200/520, 200/532, 536, 546, 559, 529, 569, 5 A, 341–345, 200/407–409, 253–256, 451, 447, 339, 553, 200/445, 557, 453, 6 R
See application file for complete search history.

(56) References Cited

U.S. PATENT DOCUMENTS 3,989,914 A * 11/1976 Stearley et al. ..... 200/453
4,118,610 A * 10/1978 Purssell et al. ..... 200/407
4,145,587 A * 3/1979 Purssell ..... 200/407
4,250,367 A * 2/1981 Rossi ..... 200/275
4,278,855 A * 7/1981 Rossi ..... 200/407
4,316,066 A * 2/1982 Muller et al. ..... 200/462
4,370,533 A * 1/1983 Kamei et al. ..... 200/521
4,394,553 A * 7/1983 Feil ..... 200/462
4,410,776 A * 10/1983 Stoll ..... 200/83 P
4,486,735 A * 12/1984 Foster ..... 337/348
4,686,401 A * 8/1987 Gehrt ..... 310/68 E
4,939,329 A * 7/1990 Dankert ..... 200/573
5,082,997 A * 1/1992 Vialy ..... 200/452
5,601,183 A * 2/1997 Boyd et al. ..... 200/553
5,790,010 A * 8/1998 Schwab ..... 337/365
5,796,058 A * 8/1998 Aimi et al. ..... 200/16 D
6,222,144 B1 * 4/2001 Nishikawa ..... 200/537
6,248,966 B1 * 6/2001 Nakase et al. ..... 200/557

FOREIGN PATENT DOCUMENTS

CN 1053520 6/2000

* cited by examiner

*Primary Examiner*—Elvin Enad
*Assistant Examiner*—Lisa Klaus
(74) *Attorney, Agent, or Firm*—Wei Te Chung

(57) ABSTRACT

A push switch includes an insulative housing (1), a pair of fixed terminals (2), a moveable contact (3) and an actuator (4). The insulative housing (1) made of insulative material has a base (10), a plurality of periphery walls (11), (12), (13), (14) extending upwardly from the base (10). The pair of fixed terminals (2) mounted in the insulative housing (1) include a pair of exposed contacting portions (211), (221) and a pair of extending portions (210), (220) extending outside. The moveable contact (3) driven by the actuator (4) includes a connecting portion (34), a first arm (31), a third arm (33) contacting with one of the fixed terminals (2) and a second arm (32) extending downwardly with respect to the connecting portion (34).

17 Claims, 6 Drawing Sheets

PUSH SWITCH

BACKGROUND OF THE INVENTION

1. Field of the Invention

The present invention generally relates to a push switch used in various electronic appliance.

2. Description of Prior Arts

A conventional push switch described in CN Patent Issue No. 1,053,520 comprises an insulative housing defining a cavity, a moveable contact, an actuator and a pair of fixed terminals. The fixed terminals are mounted in the cavity of the insulative housing. The actuator is rotatably mounted on the insulative housing. The moveable contact has a first arm and a second arm with a substantially "U" shaped configuration therebetween, wherein the first arm is fixed with the actuator and the second arm defines a pair of touching portions for contacting with the fixed terminals.

In a normal position, one of the touching portions is connected with a corresponding fixed terminal all the time, while the other one is disconnected with the other one of the fixed terminals. When an external force is exerted on the actuator, the actuator is displaced from an original portion to a final position, and the pair of touching portions slide forward to allow the one disconnected with the fixed terminals having a connection with the corresponding fixed terminal. Hence, the electrical connection between the moveable contact and the fixed terminals is established. However, the external force making the touching portions move forward is supported only by the second arm. As a result, the endurance of the structure is weak, and it is easy to break.

Hence, it is desirable to have an improved push switch to overcome the above-mentioned disadvantages of the prior art.

SUMMARY OF THE INVENTION

It is an object of the present invention to provide a push switch including an improved moveable contact assembled therein.

In order to achieve the above-mentioned object, a push switch in accordance with the present invention comprises an insulative housing, a pair of fixed terminals, a moveable contact and an actuator. The insulative housing made of insulative material has a base, a plurality of periphery walls extending upwardly from the base. The fixed terminals mounted in the insulative housing include a pair of exposed contacting portions and a pair of extending portions extending outside. The moveable contact driven by the actuator comprises a connecting portion, a first and a third arms contacting with the fixed terminals, and a second arm extending downwardly with respect to the connecting portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
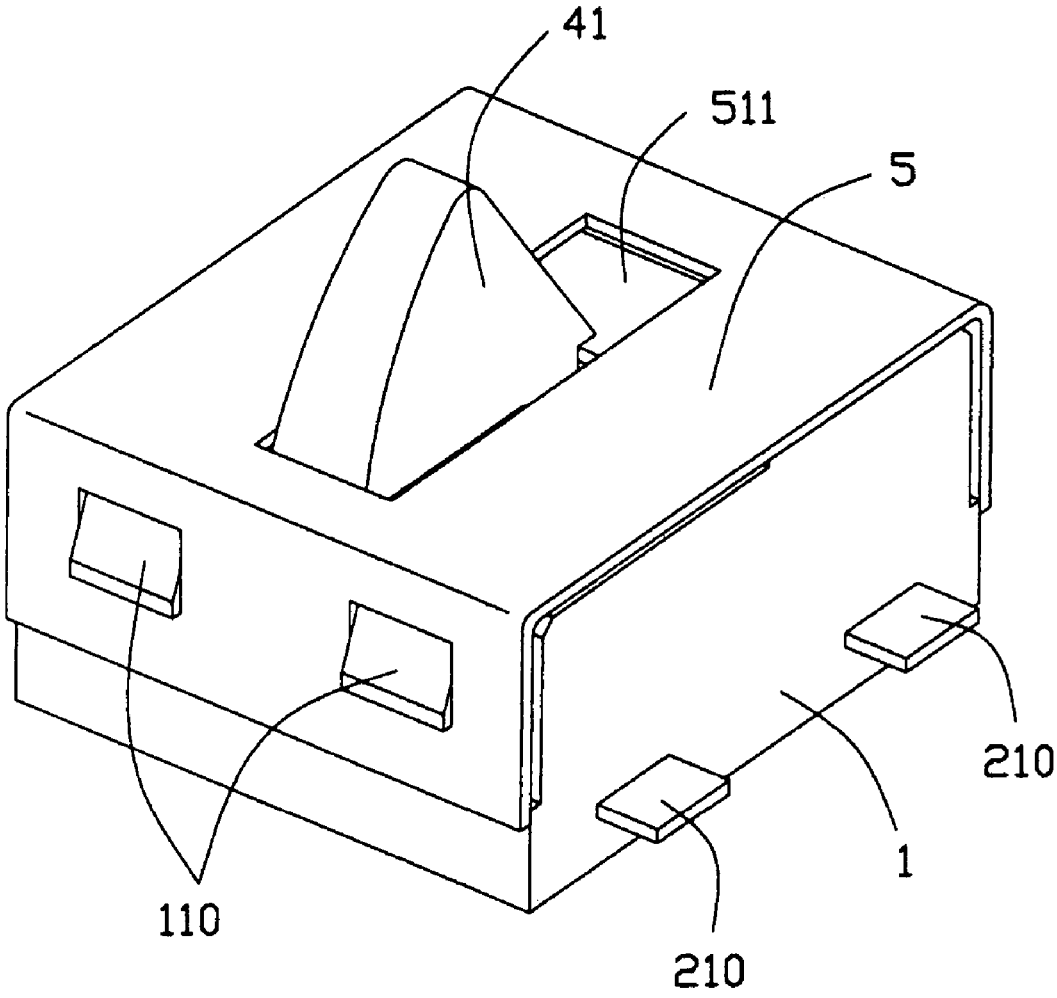
FIG. 1 is an assembled perspective view of a push switch in accordance with the present invention.
Figure 2:
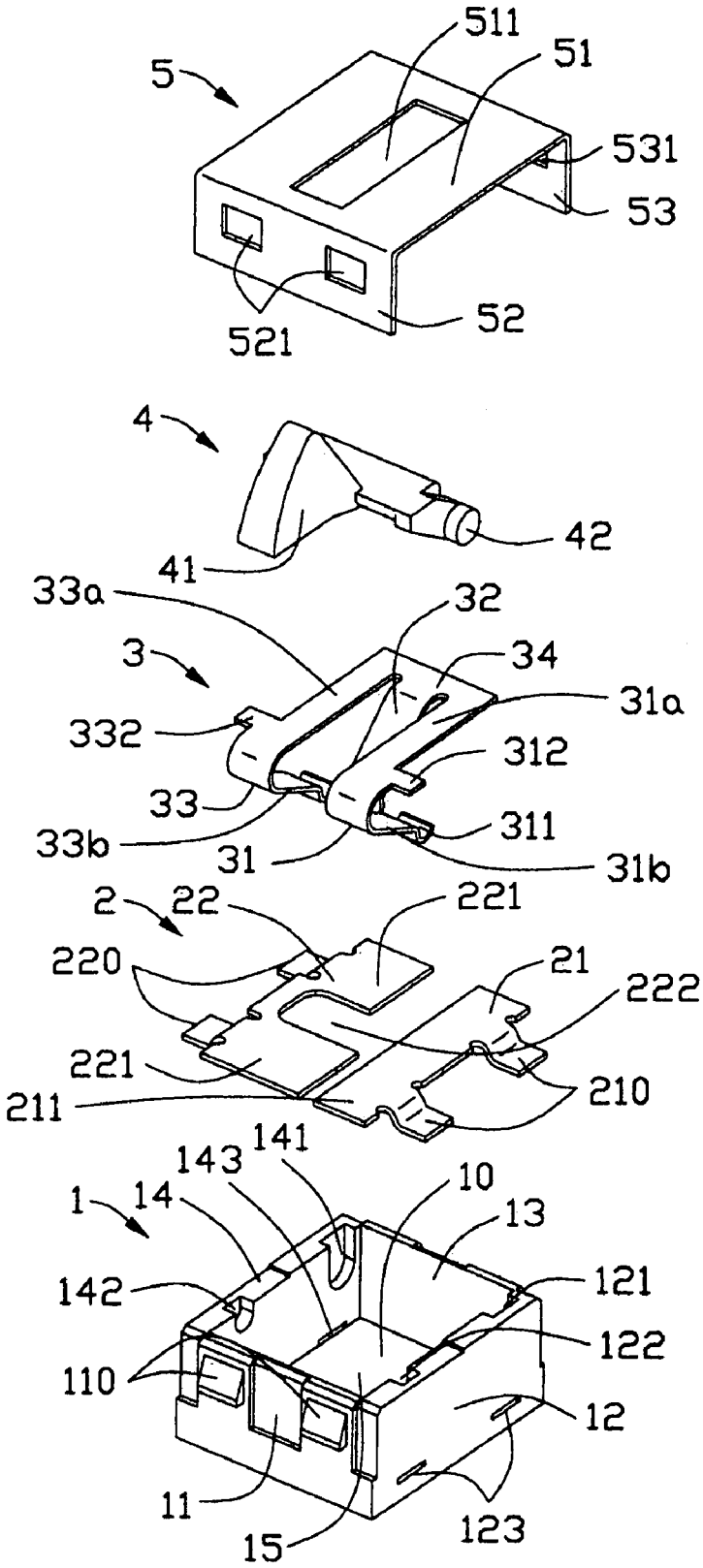
FIG. 2 is an exploded, perspective view of the push switch of FIG. 1.
Figure 3:
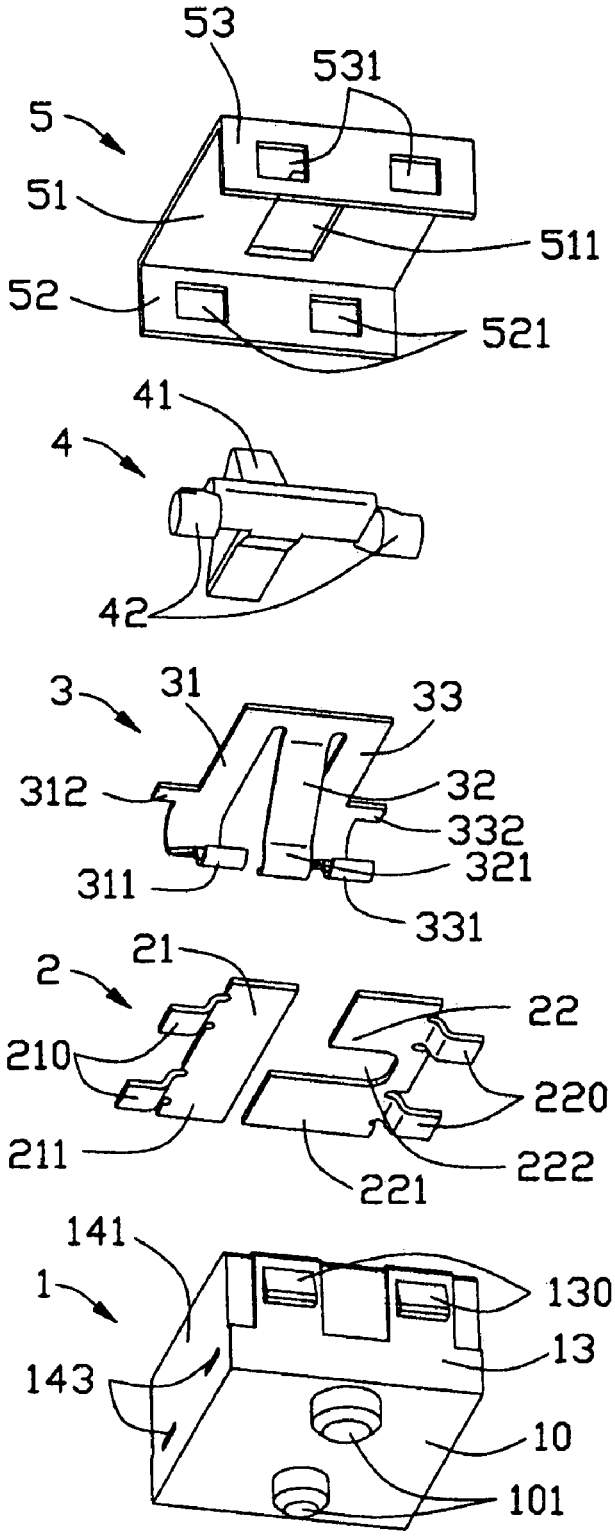
FIG. 3 is a view similar to FIG. 2, but taken from a different perspective.
Figure 4:
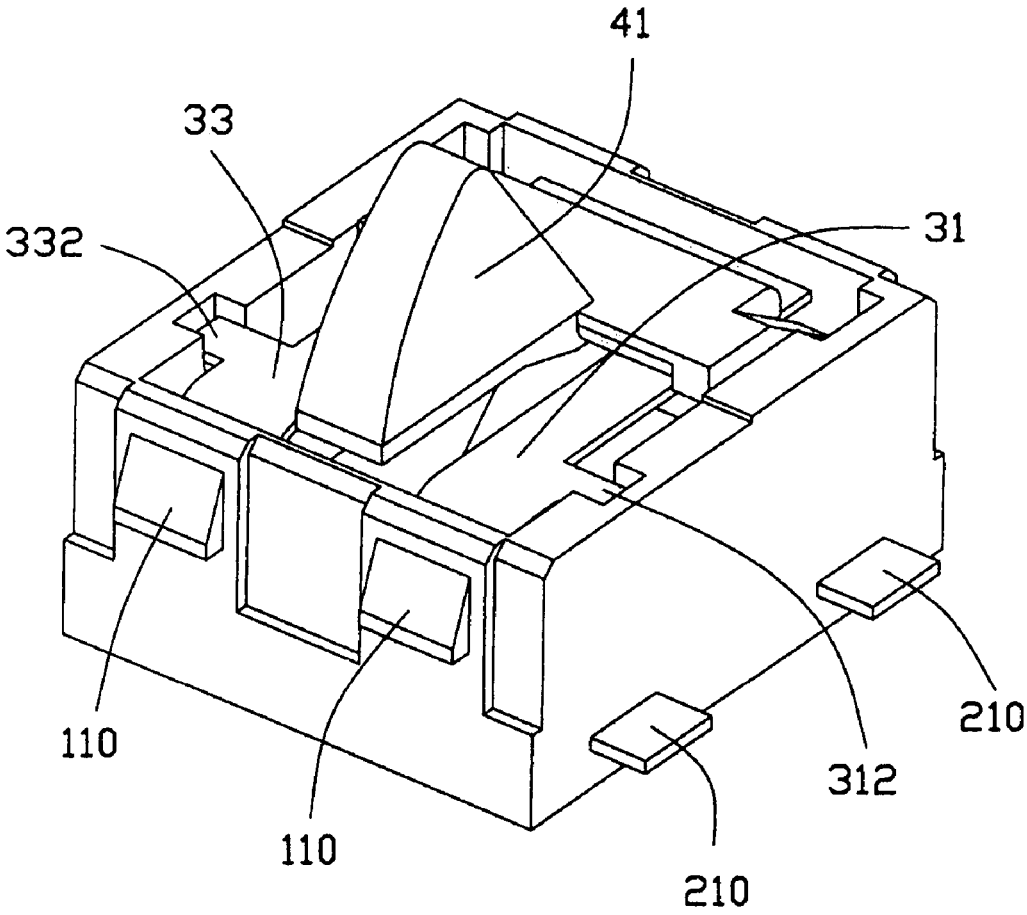
FIG. 4 is an assembled perspective view of the push switch of FIG. 1, without a cover.
Figure 5:
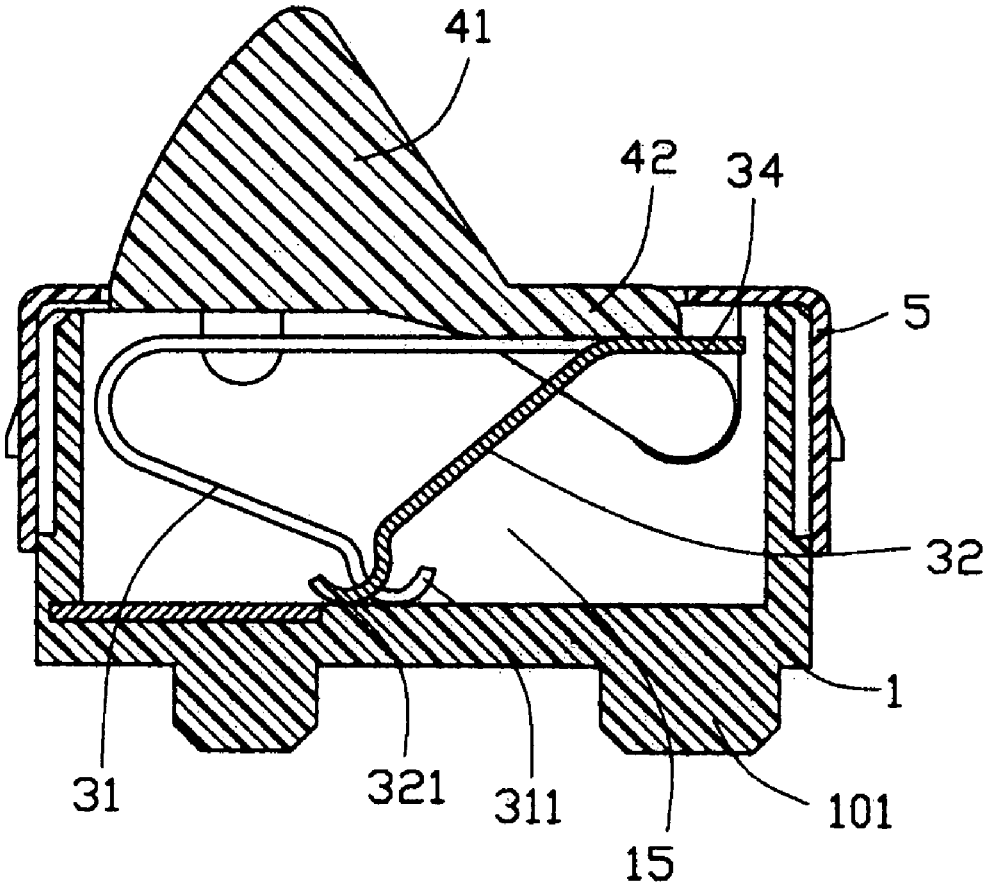
FIG. 5 is a cross-sectional view of the push switch of FIG. 1.

Reference will now be made to the drawing figures to describe the present invention in detail.

With reference to FIGS. 1 to 5, a push switch in accordance with the present invention comprises an insulating housing 1, a pair of fixed terminals 2, a moveable contact 3, an actuator 4 and a cover 5.

The insulative housing 1 made of insulative material has a base 10 and a plurality of periphery walls extending upwardly from the base 10 to thereby define a cavity 15 therebetween. The periphery walls comprise opposite front and rear walls 11, 13 and opposite right and left walls 12, 14. Two pairs of protrusions 110, 130 are formed on the outside of the front and rear walls 11, 13. A pair of first recesses 121, 141 and a pair of second recesses 122, 142 are respectively and symmetrically defined in an inner surface of the right and left walls 12, 14. Two pairs of slits 123, 143 corresponding to the fixed terminals 2 are respectively defined through the lower part of the right and left walls 12, 13 along a horizontal direction. A pair of posts 101 extend downwardly from a bottom surface of the base 10.

The fixed terminals 2 made of conductive material comprise a first fixed terminal 21 and a second fixed terminal 22. The first fixed terminal 21 is mounted in the base 10 including a first contacting portion 211 and a pair of first extending portions 210 extending outside through the corresponding slits 123. The second fixed terminal 22 is mounted in the base 10 and positioned beside the first fixed terminal 21. The second fixed terminal 22 includes a pair of second contacting portions 221, an indentation 222 located between the pair of second contacting portions 221, and a pair of second extending portions 220 extending outside through the corresponding slits 143. The first and second contacting portions 211, 222 are both exposed to the air.

The moveable contact 3 made of flexible conductive material has a first arm 31, a third arm 33, a second arm 32 located between the first arm 31 and the third arm 33, and a connecting portion 34 connecting these arms together. The first and third arms 31, 33 each has a substantially U-shaped configuration. The first and third arms 31, 33 each comprises a front portion 31*a*, 33*a* extending forward from the connecting portion 34 and an end portion 31*b*, 33*b* extending downwardly and rearwardly from the front portions 31*a*, 33*a*. The pair of front portions 31*a*, 33*a* each forms a locking blade 312, 332 thereon. The first and third arms 31, 33 are respectively formed with a first and third contacting points 311, 331 at the free ends thereof. The second arm 32 extends downwardly with a certain angle with respect to the connecting portion 34. The second arm 32 has a second contacting point 321 formed at the free end thereof. The second contacting point 321 between the first and third contacting points 311, 331 is capable to slide forward due to the U-shaped first and third arms 31, 33. The second arm 32 and the end portions 31*b*, 33*b* extend in opposite direction.

The actuator 4 includes an actuating portion 41 with a substantially sector shape and a pivot 42 having two ends adapted to be received in the first recesses 121, 141. The actuating portion 41 is capable of rotating around the pivot 42 when an external force is exerted on the actuating portion 41.

The cover 5 has a pair of parallel beam sections 52 and a rectangular board portion 51 joining the beam sections 52. The beam sections 52 each defines a pair of through holes 521 for engaging with the pair of protrusions 110, 130 of the insulative housing 1. The board section 51 defines a rectangular groove 511 along a horizontal direction.

In assembly, the fixed terminals 2 are mounted in the cavity 15 of the insulative housing 1, wherein the first fixed terminal 21 is mounted at the right side of the base 10 and the second fixed terminal 22 is positioned beside the first fixed terminal 21. The first and second contacting portions 211, 221 are both exposed to the air. The first and second extending portions 210, 220 respectively extends outside through the corresponding slits 123, 143. The moveable contact 3 is disposed above the fixed terminals 2 with the pair of locking blades 312, 332 received in the pair of the second recesses 122, 142. At the same time, the first contacting point 311 keeps contacting with the first contacting portion 211 of the first fixed terminal 21, the third contacting point 331 is located in the indentation 222 of the second fixed terminal 22, and the second contacting point 321 is disconnected with either of the fixed terminals 21, 22. The actuator 4 against which the moveable contact 3 is abutted is received in the insulative housing 1, with the pivot 42 rotatably received in the pair of first recesses 121, 141. The cover 5 is mounted on the insulative housing 1, with the pair of through holes 521, 531 engaged with the protrusions 110, 130 of the housing 1. The actuating portion 41 of the actuator 4 extends outside through the groove 511 of the cover 5.

In operation, when an external force is exerted on the actuator 4, actuating portion 41 rotates around the pivot 42 to depress the moveable contact 3. The connecting portion 34 of the moveable contact 3 is pressed downwardly to make the second arm 32 slide forward to contact the second contacting portion 221 of the second fixed terminal 22, at the same time, the first contacting point 311 still keeps contacting with the first fixed terminal 21, thus the first and the second fixed terminals 21 and 22 are electrically connected with each other, the switch is on. Once the external force is released from the actuator 4, the actuator 4 returns to the original position, the moveable contact 3 also restores to the original position due to the resiliency thereof, thus the switch is off now.

Figure 6:
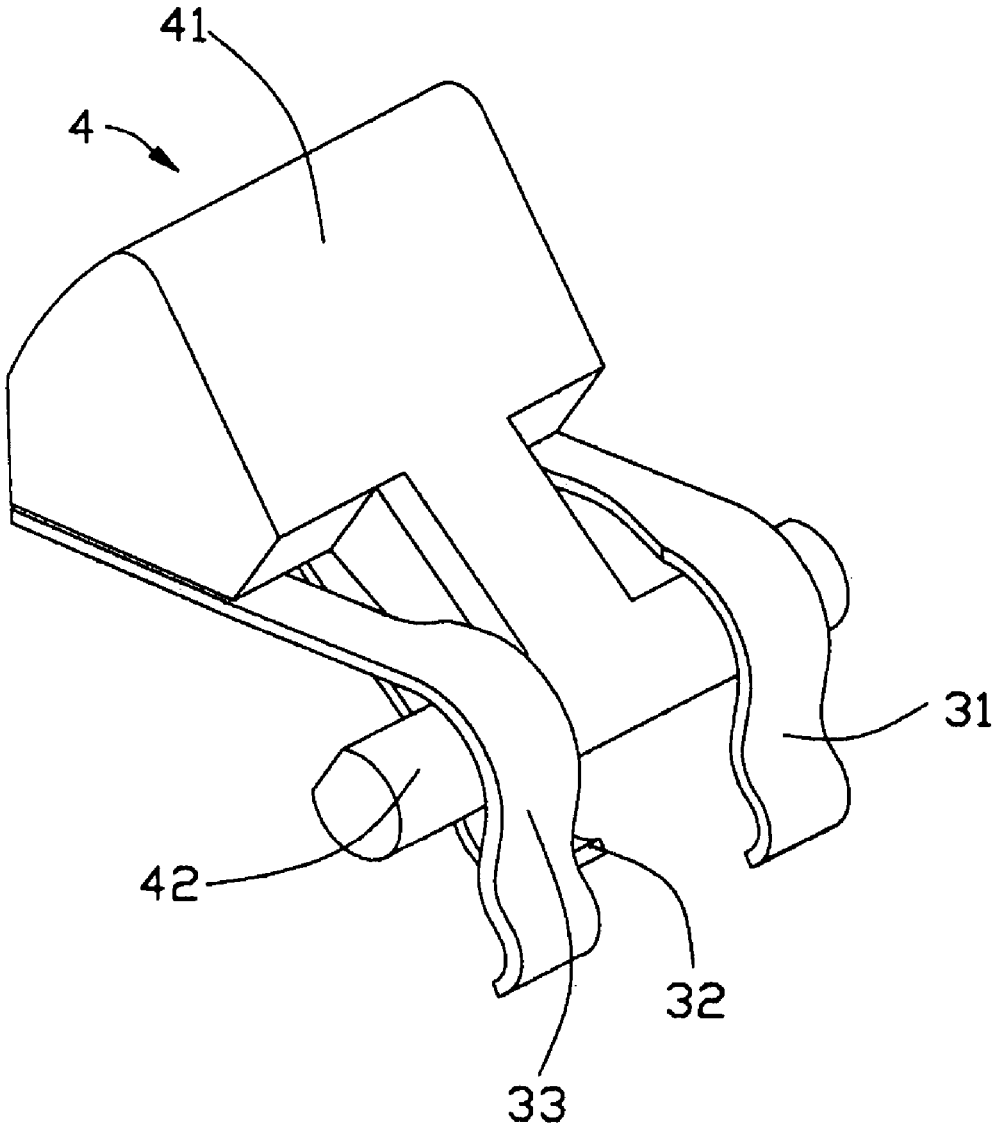
FIG. 6 is an assembled view of an actuator and a moveable contact in an alternative embodiment.

Referring to FIG. 6, in an alternative embodiment, the actuator 4 and the moveable contact 3 could be assembled as a single one, and the pivot 42 is located between the second arm 32 and the first, third arms 31, 33.

As is described in the foregoing, the moveable contact 3 includes the first and the third arms 31, 33 and the second arm 32 located between the first and the third arms 31, 33. The first and the third arms 31, 33 have the front portions 31*a*, 33*a* and the end portions 31*b*, 33*b* with a U-shaped configuration therebetween. The extending direction of the second arm 32 and the front portions 31*a*, 33*a* are different. Thus, the external force is received by the three arms 31, 33, 32 from two different directions. As a result, the exerted force is supported not only by more arms, but also in balance, so that the endurance of the structure will be enhanced and it is hard to break.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A push switch, comprising:

an insulative housing defining a cavity therein;

a pair of fixed terminals mounted in the insulative housing;

a moveable contact comprising a connecting portion, a first and a third arms extending from the connecting portion, one of the first and the third arms contacting with one of the fixed terminals, and a second arm extending downwardly from the connecting portion and being capable of contacting with a corresponding fixed terminal; and an actuator rotatably received in the insulative housing for actuating the second arm of the moveable contact to contact wit the corresponding fixed terminal along a direction opposite to a moving direction of said one of the first and the third arms.

2. The push switch as described in claim 1, wherein the first and the third arms each has a front portion extending forwardly from the connecting portion and an end portion extending downwardly and rearwardly from the front portion.

3. The push switch as described in claim 2, wherein the end portions of the first and the third arms extend in a first direction, and the second arm extends in a second direction opposite to the first direction.

4. The push switch as described in claim 2, wherein one of the fixed terminals defines an indentation in which the end portion of the third arm is located, and the other one of the fixed terminals is connected with the end portion of the first arm.

5. The push switch as described in claim 1, wherein the insulative housing defines a pair of first and second recesses thereon, and the first and the third arms have lacking blades respectively received in the second recesses.

6. The push switch as described in claim 5, wherein the actuator comprises an actuating portion and a pivot, and the actuating portion is rotatebly mounted on the insulative housing and the pivot has two ends adapted to be received in the first recesses.

7. The push switch as described in claim 1, further comprising a cover mounted on the insulative housing.

8. The push switch as described in claim 7, wherein the cover defines a groove thereon and the actuator partly extends outside through the groove.

9. A push switch comprising:

an insulative housing defining a cavity therein;

opposite first and second fixed terminals mounted in the insulative housing;

a movable contact comprising a connecting portion, a first arm and a second arms extending from opposite areas of the connecting portion and being arranged side by side with each other along a transverse direction which is pemendicular to an extension direction of said one of the first arm and the second arm; and an actuator rotatably moveable relative to the housing for actuating the second arm of the moveable contact to contact with the corresponding fixed terminal along a direction opposite to a moving direction of the first arm; wherein when the moveable contact is located in a first position, both the first arm and the second arm respectively contact the corresponding first and second fixed terminals; wherein the moveable contact is located in a second position, at least one of said first arm and second arm leaves from the corresponding one of said first and second fixed terminals.

10. The push switch as described in claim 9, wherein said moveable contact is in a compressed manner when said moveable contact is located in the first position, and in a relaxed manner in the second position.

11. The push switch as described in claim 9, wherein said first arm and said second arm extend in opposite directions.

12. The push switch as claimed in claim 9, wherein said moveable contact further includes a third arm cooperating with the first arm to sandwith said second arm.

13. The push switch as described in claim 12, wherein said second arm is said at least one of said arm and said second arm.

14. The push switch as described in claim 13, wherein said first arm, said second arm and said third arm are side by side arranged with one another along a transverse direction perpendicular to an extension direction of said one of the first arm and the second arm.

15. The push switch as described in claim 9, wherein said actuator is pivotal relative to the housing.

16. The push switch as described in claim 15, wherein a pivot of said actuator is located between the first arm and the second arm.

17. A push switch comprising:

an insulative housing defining a cavity therein;

opposite first and second fixed terminals mounted in the insulative housing;

a moveable contact comprising a connecting portion, a first arm and a second arms extending from opposite areas of the connecting portion; and an actuator rotatably moveable relative to the housing for actuating the moveable contact to contact with the corresponding fixed terminal; wherein when the moveable contact is located in a first position, both the first arm and the second arm respectively contact the corresponding first and second fixed terminals; wherein the moveable contact is located in a second position, at least one of said first arm and second arm leaves from the corresponding one of said first and second fixed terminals; wherein said actuator is pivotal relative to the housing; wherein a pivot of said actuator is located between the first arm and the second arm.

* * * * *